United States Patent [19]

Breedlove

[11] Patent Number: 4,510,878

[45] Date of Patent: Apr. 16, 1985

[54] VOLUME-ADJUSTABLE DIVERS LIFT BAG

[76] Inventor: James W. Breedlove, 424 E. Pine #5, Santa Ana, Calif. 92701

[21] Appl. No.: 536,301

[22] Filed: Sep. 27, 1983

[51] Int. Cl.[3] ..... B63B 21/52

[52] U.S. Cl. ..... 114/54; 114/315

[58] Field of Search ..... 114/53, 54, 331, 315; 441/25, 26, 29, 30; 248/74 R, 75, 79

[56] References Cited

U.S. PATENT DOCUMENTS

| | | | |
|---|---|---|---|
| 1,367,250 | 2/1921 | Gray | 114/53 |
| 2,252,072 | 8/1941 | Gerhardt | 248/79 |
| 2,451,002 | 10/1948 | Sturtevant | 114/54 |
| 2,635,574 | 4/1953 | Sturtevant | 114/54 |
| 3,208,475 | 9/1965 | Ludlow et al. | 137/494 |
| 3,263,638 | 8/1966 | Cressman | 114/53 |
| 3,512,493 | 5/1970 | Hallanger | 441/29 |
| 3,631,551 | 1/1972 | Miller | 9/8 R |
| 3,659,299 | 5/1972 | Davidson et al. | 9/8 R |
| 3,940,814 | 3/1976 | Bayles et al. | 9/8 R |
| 4,092,756 | 6/1978 | Stier | 114/54 |

*Primary Examiner*—Trygve M. Blix
*Assistant Examiner*—Edwin L. Swinehart
*Attorney, Agent, or Firm*—James D. Thackrey

[57] ABSTRACT

In a lift bag used by divers to lift objects from the ocean bottom to the surface, this invention keeps constant the amount of flotation gas and hence the lift force. A hose connects the gas bubble trapped inside the bag to a point, lower on the bag wall, selected by the diver to give the desired lift force. As the device ascends, lifting the cargo to the surface, any excess volume of gas created by expansion is discharged through the hose. The purpose is to prevent uncontrolled rapid rise of the device which can cause deflation and re-sinking when the lift bag reaches the surface.

5 Claims, 4 Drawing Figures

VOLUME-ADJUSTABLE DIVERS LIFT BAG

BACKGROUND OF THE INVENTION

1. Field of the Invention

In retrieving or salvaging objects from the bottom of oceans or lakes, a diver has need to send things to the surface without himself surfacing. This invention is in the field of devices the diver can carry in sufficient numbers to salvage several objects in a single dive. Such devices allow the diver to make better use of his diving time and reduce the number of decisions—to salvage or not to salvage—required of the diver.

2. Description of Prior Art

The common object-lifting device used by divers is a fixed-volume bag, which is inverted, attached to the object to be lifted, and filled with enough gas to lift the object. As the device rises above the ocean floor pressure decreases rapidly. The volume of the gas trapped inside it increases, and as the lifting force is proportional to that volume, the lifting force rises rapidly. Thus, when the loaded device reaches the surface, it is moving upwardly quite rapidly. Frequently the bag pops up above the surface. If on falling back it lands on its side or out-of-square, the bag may lose its gas and its buoyancy. Then the device and object sink again, perhaps unnoticed by the diver.

Several improvements in lift devices overcome this basic problem. A bleed valve on top of the bag may be manipulated to control the rate of ascent, or a dump cord attached to the bag may rock it to allow excess gas to escape. Both these require that the diver ascend with the device or manipulate it by lines from the ocean floor during the ascent. U.S. Pat. Nos. 2,451,002, 2,635,574, 3,659,299, 3,208,475, and 3,940,814 cover a variety of means to control dumping of excess gas in an ascending lift bag. These means all have internal moving parts and seals which may be subject to handling damage, fouling, or corrosion in the service environment. Miller (U.S. Pat. No. 3,631,551) uses the simpler expedient of a movable hole in the sidewall of a cannister to allow the diver to control the volume of buoyancy gas. The means for achieving movability of the hole—a zipper which closes both ends—is also subject to handling damage or fouling.

SUMMARY OF THE INVENTION

In my invention, an inverted bag of flexible material is attached to the object to be lifted. The open end of the bag, which faces downward in use, is fitted with straps or lines around its periphery leading to a ring, hook, or strap to facilitate attachment to the object. A hose runs from the closed top of the bag toward the bottom. The lower end of this hose may be attached to the bag wall at an elevation selected by the diver. In use, the diver attaches the object to be lifted, also called the cargo, and then fills the inverted bag with gas from his breathing apparatus, while holding the loaded device to prevent its ascending. Gaging the upward force by feel, he places the lower end of the hose on the bag wall at successively higher positions until the net buoyancy of the device creates the lifting force he desires, attaching the lower end of the hose to the bag wall at that elevation. Finally he releases the loaded device, which moves upward to the surface with its ascent rate controlled. As the device rises the gas trapped in the bag expands, but the lifting gas volume remains constant since water pressure within the bag forces any excess gas volume to be expelled through the hose. Therefore the lifting force is constant and may be preset as the diver/operator desires.

An object of this invention is to provide a diver's lift bag which ascends in a controlled manner with no moving parts.

Another object is to provide a lifting device which is compact and may be stored at many places on the diver's body or gear without danger of damage.

DESCRIPTION OF THE PREFERRED EMBODIMENT

Figure 1:
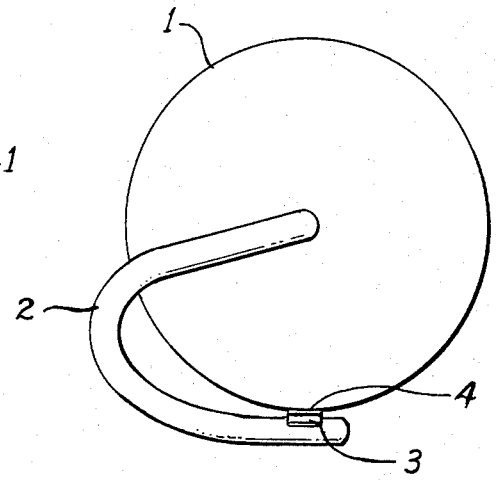
FIG. 1 is a view from the top of the device.

A view of the invention looking down is shown in FIG. 1. The inverted bag 1 is seen from its closed upper end, the lower end being open.

Hose 2 which communicates with the interior of bag 1 is also seen in this view. Although the top view of bag 1 as shown is circular, it can be any convenient shape.

Figure 2:
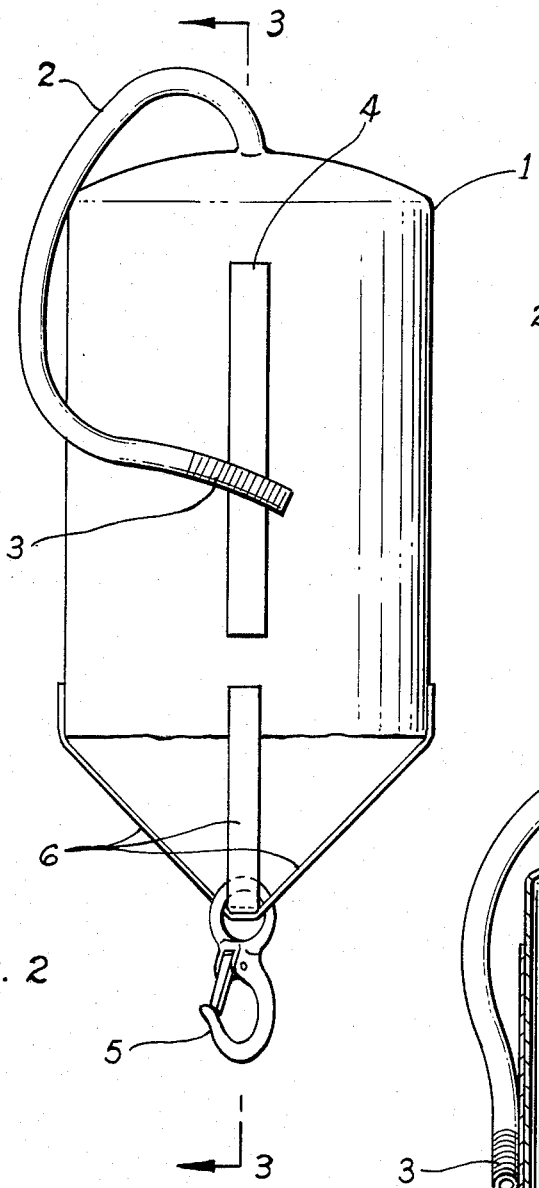
FIG. 2 is a side view of the preferred embodiment.

The preferred embodiment is best illustrated in FIG. 2. As described above, a hose 2 is communicably attached to the closed end of inverted bag 1. The end of hose 2 remote from bag 1 is fitted with one of two components of a hose attachment means, illustrated as Item 3. The mating component is illustrated as Item 4; when placed together or pressed together these two components grip each other securely. The grip can be broken by proper application of force such as a man's hand can exert, but not by lesser forces such as a wave striking the hose attachment means. In the preferred embodiment hook-and-loop pile materials are used for Items 3 and 4. It is not important whether hooks or loops are used for Item 3 as long as the opposite (loops or hooks) is used for Item 4. As shown, Item 4 extends vertically along the external surface of bag 1 in order to permit hose 2 to be attached at any desired elevation.

Figure 3:
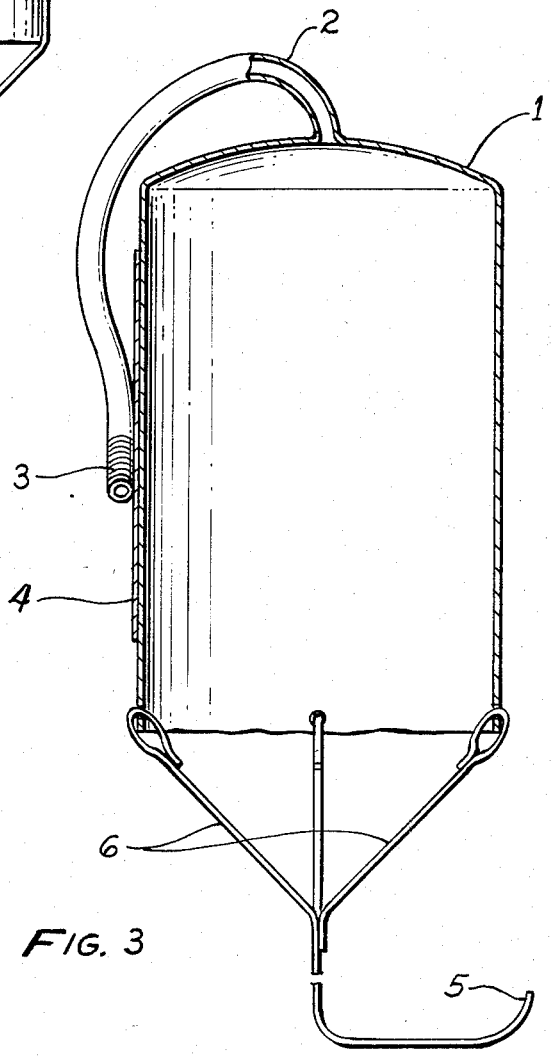
FIG. 3 is a cross sectional view taken as shown in FIG. 2, except that alternate cargo attachment means Items 5 and 6 are shown.

Cargo attachment means 5 is fixed to bag 1 through tie members 6. The arrangement may be seen in FIGS. 2 and 3, which differ in that a safety hook is shown as cargo attachment means 5 in FIG. 2 and a strap is shown as Item 5 in FIG. 3. Likewise Item 6 is shown as straps in FIG. 2 and as ropes in FIG. 3. The preferred embodiment is as shown in FIG. 2.

Figure 4:
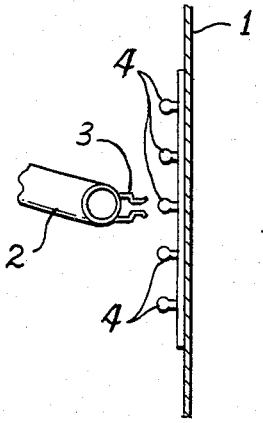
FIG. 4 shows an alternate hose attachment means.

It is obvious that widely diverse embodiments of this device are possible within the basic inventive concept, even for salvaging specific objects. The inventive concept common to all is the provision to allow the hose attachment elevation to be chosen by the diver so as to control the volume of gas trapped within the bag. As an additional example among many for accomplishing this, FIG. 4 shows an arrangement using male and female snap-halves as Items 3 and 4. It is also noted that the inverted bag 1 may be constructed of a variety of materials. As long as it is substantially gas-tight the function will not be affected, yet the compactness during storage and transport by the diver may be enhanced.

If hook or loop material is used for Item 3, a patch of this material fixed near the open end of hose 2 is sufficient for function.

Two tie members 6, equally spaced around the periphery of bag 1 at the open end, are sufficient to center the cargo weight under the lift force. However, four tie members are preferred because they increase the stability during ascent, and when the device is stationary on the surface prior to retrieval.

The invention having been described in its preferred embodiment, it is clear that modifications are within the ability of those skilled in the art and without the exercise of the inventive faculty. Accordingly the scope of the invention is defined in the scope of the following claims.

I claim:

1. A device for lifting objects from the floor of a body of water to the surface with a constant preset lifting force, comprising;

an inverted bag of substantially gas-tight material, and a plurality of first components of a hose attachment means distributed along the height dimension of said bag and fixed to the outer surface thereof, and a hose one end of which is communicably attached to the closed end of said bag, and a second component of the hose attachment means fixed to the side of said hose adjacent the other end, said second component being capable of engaging said first component to create the hose attachment means, and cargo attachment means fastened to said bag at two or more points on the periphery of the open end, whereby the object to be lifted may be secured to said cargo attachment means, said inverted bag filled with gas, and said second component of the hose attachment means engaged successively with the plurality of first components of the hose attachment means, starting with the lowest first component and proceeding until the desired lifting force is obtained, whereupon when released the device will lift the object to the surface with the desired lifting force while spilling excess gas through said hose.

2. A device for lifting objects from the floor of a body of water to the surface with a constant lifting force of the desired magnitude, comprising:

an inverted bag of flexible substantially gas-tight material, and a strip of hook-and-loop material extending along the outer surface of said bag from the open end toward the closed end, and a hose one end of which is communicably attached to the closed end of said bag, and a patch of hook-and-loop material, selected to mate with the material of said strip, fixed to the outer surface of said hose near the other end, and a cargo attachment means, and at least two flexible tie members fixed at one end to said cargo attachment means and having the other ends spaced approximately equally around, and fixed to, the open end of said bag, whereby the object to be lifted may be secured to said cargo attachment means, said inverted bag may be filled with gas, and said hose attached to the outer surface of said bag, by causing said patch of hook-and-loop material to engage said strip of hook and loop material, at the position which causes the desired constant lifting force, such force staying constant because as the device rises the volume and lifting force of gas trapped in said bag will be constant, excess gas being free to escape through said hose.

3. A device as in claim 2, in which said cargo attachment means is a safety hook.

4. A device as in claim 2, in which said cargo attachment means is a ring.

5. A device as in claim 2, in which said cargo attachment means is a strap.

* * * * *